US005452936A

United States Patent [19]

Koehring

[11] Patent Number: 5,452,936

[45] Date of Patent: Sep. 26, 1995

[54] SELF-CUSTOMIZING RESTAURANT BOOTH

[75] Inventor: Richard Koehring, Burnsville, Minn.

[73] Assignee: Waymar Industries, Inc., Burnsville, Minn.

[21] Appl. No.: 144,739

[22] Filed: Oct. 29, 1993

[51] Int. Cl.[6] ..... A47C 9/04

[52] U.S. Cl. ..... 297/172; 297/158.1; 297/161

[58] Field of Search ..... 297/121, 135, 297/158, 161, 172, 245, 249, 440.1, 440.24; 108/137, 102

[56] References Cited

U.S. PATENT DOCUMENTS

| | | | |
|---|---|---|---|
| 1,355,681 | 10/1920 | McNulty | 297/172 |
| 1,454,565 | 5/1923 | Sanford | 297/172 |
| 3,858,933 | 1/1975 | Koehring . | |
| 4,023,859 | 5/1977 | Hagenson | 297/158 |
| 4,653,803 | 3/1987 | Crowe | 297/158 |
| 4,850,642 | 7/1989 | Crowe | 297/158 |

FOREIGN PATENT DOCUMENTS

| | | | |
|---|---|---|---|
| 2452898 | 12/1980 | France | 108/102 |

OTHER PUBLICATIONS

Waymar Sales Brochure 1989.

*Primary Examiner*—Laurie K. Cranmer
*Attorney, Agent, or Firm*—Palmatier, Sjoquist & Helget

[57] ABSTRACT

A booth for a restaurant having a pair of seat-supporting horses that have vertical support legs and a horizontal bar between the legs, a sleeve affixed to each horse, the horses adjustably connected via the sleeve to a tabletop-supporting bridge such that the width of the booth or table can be adjusted to provide a customized fit in a restaurant, including seats attached to the horses, and a tabletop attached to the bridge.

15 Claims, 6 Drawing Sheets

SELF-CUSTOMIZING RESTAURANT BOOTH

FIELD OF THE INVENTION

The present invention relates to restaurant furniture and more specifically to restaurant tables and booths where the seats are attached to the tabletop.

BACKGROUND OF THE INVENTION

Restaurant tables and booths are commonly known. In the past, these seats and booths have been of a fixed size. The seats and tabletops are of a specific width and the chairs or benches are positioned a fixed distance away from the tabletop. Such a structure provides a rigid overall dimension of the booth assembly and creates problems when installing booths in a restaurant. Positioning of the booth the same way requires substantial planning and effort. The main problem causing the excessive planning efforts is due to the rigid dimensions of the booth assembly and the fact that rooms in a restaurant have many different shapes and sizes. As a consequence the booth assemblies do not neatly fit into the restaurant. A row of booths may be longer or shorter than the wall that they are placed against. Thus, it is either impossible to install a string of booths along the wall because the string of booths is too long or there is an unsightly gap at the end of the string of booths along the wall.

Additional planning was often needed to rectify this problem. The unsightly gap can be filled with a custom production of a single booth that fills the gap. An alternative method for resolving the space problem is through the sale of booths of many different sizes. The overall length of the string of booths can be changed by inserting one booth that is a little larger or little smaller than the booths in the same string. This method still requires excessive planning, since one needs to determine how many booths of a particular size and how many booths of a second size are required to fill a string of booths. The planning and customizing causes a substantial loss of time and money.

SUMMARY OF THE INVENTION

The present invention solves the space problems by providing a mechanism for adjusting the width of a booth assembly used for seating the patrons in a restaurant. The present invention includes: at least one horse, at least one chair or bench seat, a bridge and a tabletop.

Each booth may have one or more horses, which support a bench or chair, and typically, there will be two horses. Each of the horses have vertical legs joined to a horizontal support member. The vertical legs support the horizontal member off the floor of the restaurant. Each horse carries at least one sleeve at a point along the horizontal support member. This point could be at an end, in the middle, or at some other area along the horizontal support member. Each of the horses also may carry a mounting plate for the mounting of chairs or benches.

A number of different chairs or benches may be mounted to each horse, with at least one chair or bench being mounted to each horse. Each chair is designed to support one person, while benches are designed to support two or more persons. Depending on the size of the horse used, each horse may be attached to: a single chair, a plurality of chairs, a multiple-person bench or a plurality of multiple-person benches. The chairs or benches on one horse do not need to correspond in size or shape to the chairs or benches on the other horse.

Each horse is attached to a bridge. The bridge includes a horizontal bridge bar that is slidably received into the sleeve on each horse and extends between the horses. At least one vertical table support member extends upwardly from the horizontal bridge bar. A tabletop mounting plate is joined to the top of each vertical table support member and extends in a direction parallel to the horizontal bridge bar. The bridge includes either table support arms or a table brace for supporting the tabletop. A vertical leg can be used either with the arms or the brace to assist in supporting the tabletop.

The bridge is attached to a tabletop. The tabletop and the chairs can be coated for decorative and sanitary purposes. Such coatings may be laminate coatings that come in a variety of appearances including natural woods and solid colors. Alternatively, the tabletop and chairs may be finely finished wood. The finish or coating on the tabletop and chairs of any particular booth do not have to be identical.

The distance between the horses can be adjusted, since the horizontal bridge bar of the bridge assembly slidably fits into the sleeves on the horses. When the horses are in a desired position, the horses releasably secure to the horizontal bridge bar via set screws. This makes it possible to adjust the overall dimension of each booth, and solves the problem of excessive planning for placement of the booths in a restaurant.

DETAILED DESCRIPTION OF THE PREFERRED EMBODIMENTS

Figure 1:
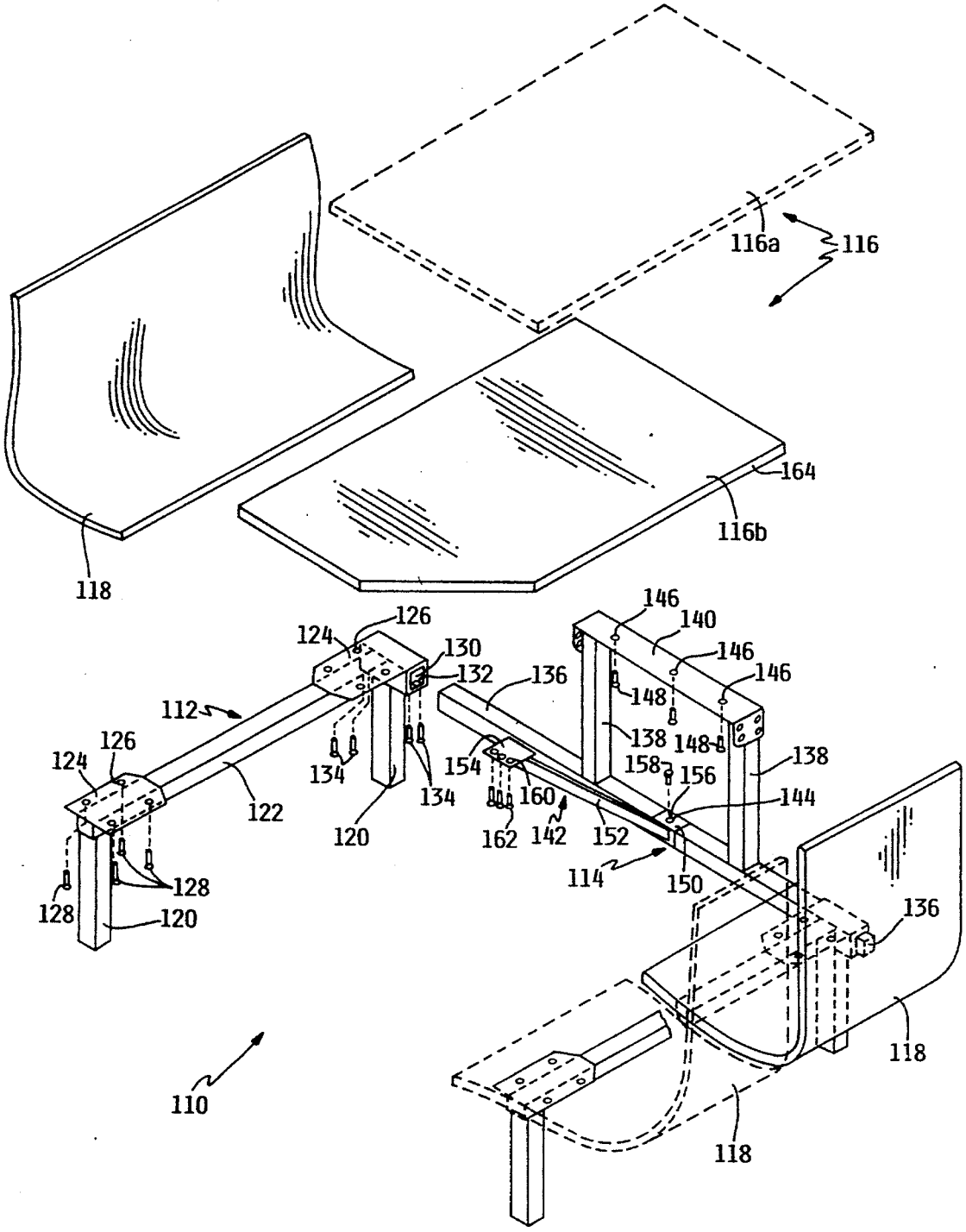
FIG. 1 is an exploded view of the present invention showing the first embodiment.

Various embodiments of the present invention are shown in each of the FIGS. 1–6. It is recognized that one skilled in the art could readily adjust the measurements and make a booth that is larger or smaller than the booth described herein without departing from the spirit or scope of the invention. FIG. 1 shows the first embodiment of the present invention 110. It includes: the horse 112, the bridge 114, the tabletop 116, and the seats 118. These parts are discussed below.

The horse 112 includes a support mechanism such as the vertical support members 120, which are joined at the horizontal support member 122. The horses 112 can be of any suitable material and dimension. Preferably the horse 112 is constructed of a rigid material such as steel. A steel construction would allow the vertical and horizontal support members 120, 122 to be rigidly secured to each other such as by a weld. The preferred length for the horse 112 of the first embodiment is approximately 40 inches. If the horses 112 of the first embodiment are of a different length, the preferred lengths are approximately 20½ inches and 40 inches. The supports 120, 122, which may be hollow, may have a width of approximately 2 inches. Although the vertical and horizontal supports 120, 122 are shown with a square cross section, other cross-sectional shapes such as a rectangle, circle, oval, triangle or an irregular shape will work as well.

The horse 112 has at least one seat mounting plate 124, which may be permanently attached to the horizontal support member 122. The seat plate 124 defines a plurality of openings 126 through which fasteners 128 may extend. The fasteners 128 may be ⅜-inch bolts and are designed to secure the seat 118 to the horse 112.

At least one sleeve 130 is affixed to, or forms a part of, the horse 112. Sleeve 130 is a tubular member having a predetermined length, preferably somewhat longer than the thickness of the supports 120, 122. Sleeve 130 is aligned along an axis which is normal to the plane formed by the support members 120, 122, so as to project at a right angle with respect to horse 112. Sleeve 130 is a tubular member preferably of square cross section, although a circular or rectangular cross section would also be usable, so long as the cross-section shape is consistent with the cross-section shape of horizontal bridge bar 136. The internal cross-section area of sleeve 130 is slightly larger than the external cross-section area of bridge bar 136, to permit a slidable fit of bridge bar 136 within sleeve 130. One or more apertures 132 may be formed through the bottom surface of sleeve 130, to accept fasteners 134. Fasteners 134 may be threadably secured through sleeve 130 to engage against the outer surface of bridge bar 136, to create an adjustable lock to secure bridge bar 136 within sleeve 130. Sleeve 130 is preferably symmetrically mounted to horse 112, to permit horse 112 to be used in either of the two mounting configurations shown in FIG. 1. If sleeve 130 is centrally positioned along horizontal support member 122, it is preferably symmetrically mounted so as to permit the horse to be utilized in either of the two mounting positions shown in FIG. 3.

The bridge 114 includes a horizontal bridge bar 136, at least one and preferably two vertical table supports 138, a table-mounting plate 140, and a table brace 142. All parts of the bridge 112 are constructed of a sturdy material such as steel. The bridge 114, like the horse 112, does not need to have a square cross section.

The bridge bar 136 is slidably received within the sleeve 130 of the horses 112 and secured therein by the fasteners 134. This type of connection easily allows for a 6-inch adjustment of the booth width, to allow for variations in the distance patrons wish to be from the tabletop 116. If a narrower tabletop 116 is used the benches can be placed even closer together and the ends of the horizontal bridge bar 136 can simply be cut off. The horizontal bridge bar 136 may be approximately 52–58 inches long and may be welded to the vertical table supports 138. The bridge bar and the table supports may be of square cross section and hollow, having a width of approximately 2 inches. The bridge bar 136 defines an aperture 144 at approximately the midpoint thereof. The aperture 144 provides for securement of the bridge bar 136 to the table brace 142.

The table-mounting plate 140 is joined to the upper ends of the vertical table supports 138. Preferably the table-mounting plate 140 is elevated 30 inches above the floor. The table-mounting plate extends parallel to the bridge bar 136 and defines a plurality of apertures 146. The apertures 146 provide for securement of the bridge 114 to the tabletop 116 via fasteners 148. The fasteners 148 may be ⅜-inch bolts.

The table brace 142 includes a bridge bar connection plate 150, a shaft 152 and a table connection plate 154. The bridge bar connection plate 150 defines an aperture 156, having an internal diameter similar to the aperture 144 of the bridge bar 136. The apertures 144, 156 are aligned; then a 2-inch by ⅜-inch fastener 158 such as a nut and bolt secures the table brace 142 to the bridge 114. Once such securement is complete, the shaft 152 of the table brace 142 will angle away from a vertical axis. This will horizontally position the table connection plate 154 approximately 30 inches above the floor. The table connection plate 154 defines a plurality of openings 160. Fasteners 162 extend through the openings 160 to secure the tabletop 116 to the table brace 142. Thus, the table brace 142 cooperatively with the table-mounting plate 140 provides support and stability for the tabletop 116.

The tabletop **116*a* may be approximately 24–30 inches wide, approximately 42 inches long and approximately 1¼ inch thick. The tabletop 116*b* may have a short edge 164, which is approximately 24 inches long. The tabletop 116*a* is used with horses 112 of the same or similar length, while the table top 116*b* is used when one horse 112 is approximately 40 inches long and the other is approximately 20½ inches long as suggested above. The upper surface of the tabletop 116 has a decorative and sanitary laminate coating or natural wood finish. The tabletop 116 is horizontally positioned approximately 30 inches off the floor, secured to the bridge 114 via fasteners 148 and to the table brace 142 via fasteners 162** as described above.

The chairs 118 may be approximately the same length as the nearest edge of the tabletop 116 and approximately ⅝ inch to 1⅛ inch thick. The chairs 118 (shown bench style) are designed to hold multiple persons. Like the tabletop 116, the surfaces of the chairs 118 are coated with a decorative and sanitary laminate coating or wood finish. Fasteners 128 secure the chairs 118 to the horses 112. The lower edge of the chairs 118 may be horizontally positioned approximately 18 inches off the floor, while the upper edge of the backrest may be approximately 16 inches higher.

Figure 2:
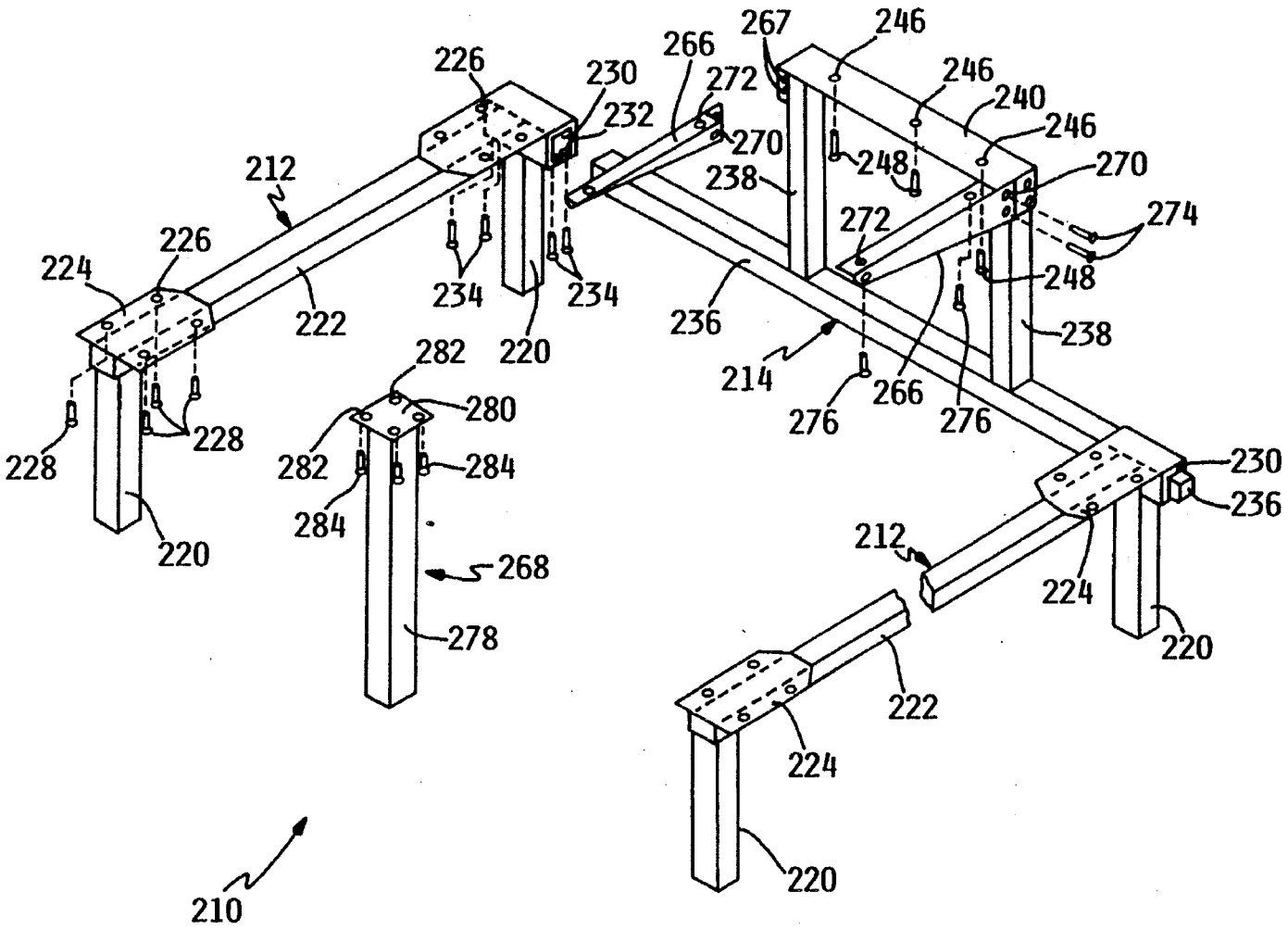
FIG. 2 is an exploded view showing the second embodiment.

FIG. 2 shows the second embodiment 210 of the present invention. Parts of the second embodiment that are similar to parts of the first embodiment have the same numbers except for the leading digit, and will not be described a second time. The second embodiment uses the tabletops **216*a*, 116*b* that are approximately 57 inches long and seats 118 of a similar length (see FIG. 1). Due to the added length the bridge 214 has been modified. This bridge 214 includes table arms 266; a vertical leg 268** is also used with this embodiment.

The table arms 266 provide support for the tabletop 116. The arms 266 define bridge openings 270 and tabletop openings 272. The bridge openings 270 are sized to receive bridge fasteners 274, which secure the table arms 266 to the table mounting plate 240 of the bridge 214 via the apertures 267 defined in the table-mounting plate 240. The tabletop openings 272 are sized to receive tabletop fasteners 276, which secure the tabletop 116 to the bridge 214. The bridge fasteners 274 and the tabletop fasteners 276 may be bolts or screws.

The vertical leg 268 includes a shaft 278 and a securement plate 280. The shaft 278 may be hollow and constructed of steel. The dimensions of the shaft 278 may be 30 inches high and 2 inches in diameter. Although the shaft 278 is shown with a square cross-sectional shape, such a shape is not necessary. The plate 280 defines apertures 282, sized to receive fasteners 284. The fasteners 284 secure the tabletop 116 to the vertical leg 268. The vertical leg 268 provides support for the tabletop 116.

Figure 3:
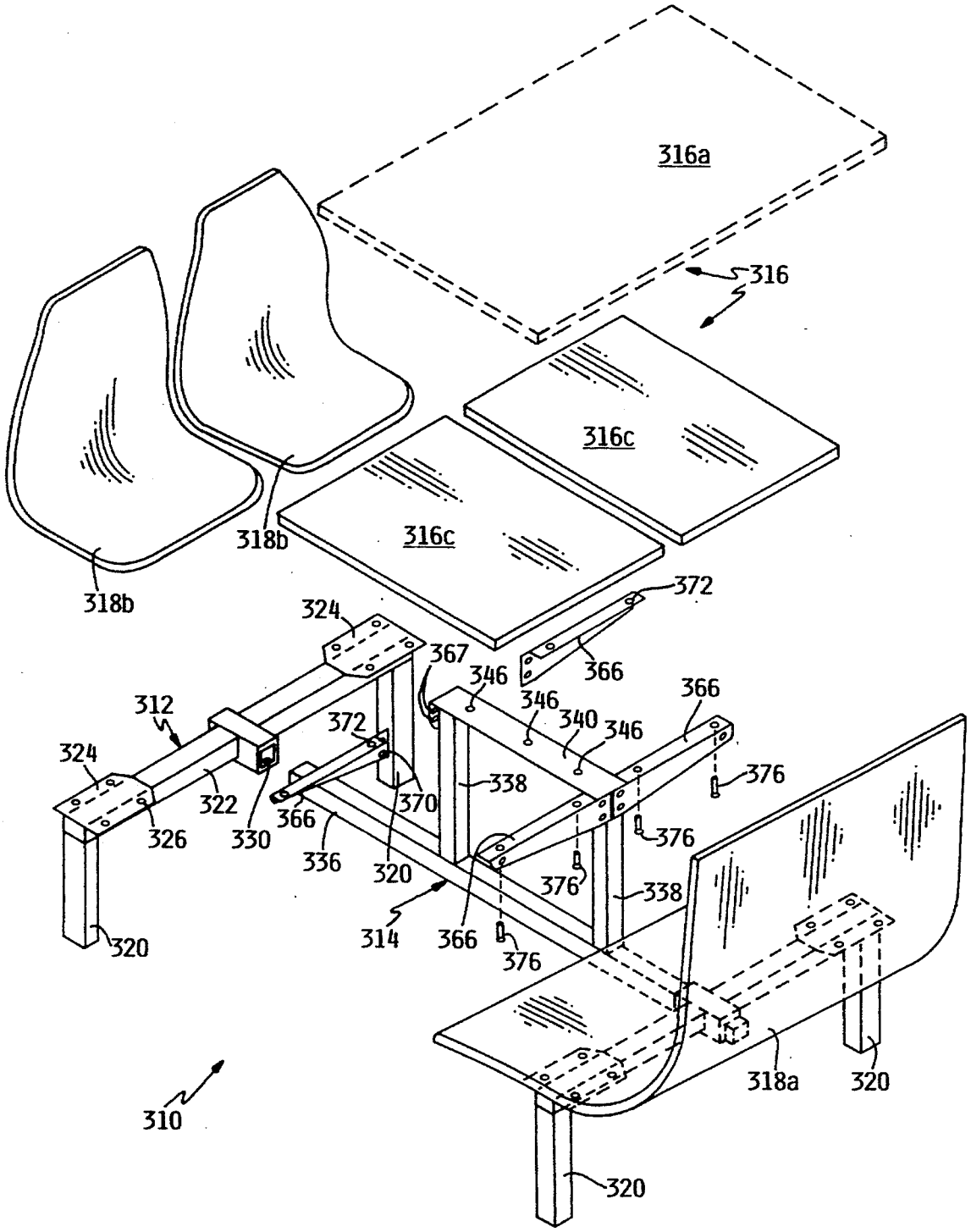
FIG. 3 is an exploded view showing the third embodiment.

FIG. 3 shows the third embodiment 310 of the present invention. Parts similar to parts of the previous embodiments are similarly numbered, except for the leading digit. The third embodiment has a bridge 314 similar to the bridge 214 of the second embodiment, although the third embodiment does not have a vertical leg 268. The third embodiment is designed to be used with the tabletop 316*a*, which is approximately 42 inches long and the bench-style seat 318*a*. It is contemplated, however, that it can be used with two similar tabletops 316*c*, which are each approximately 24 inches long, and individual chairs 318*b*. The third embodiment is also different from the first and second embodiments in the location of the sleeve 330.

The sleeve 330 is located approximately at the midpoint of the horizontal support member 322. Again it is noted that the sleeve can be located anywhere along the length of the horizontal member 322 and not just at the midpoint or the end thereof. Positioning the sleeve 330 at the midpoint of the horizontal member 322 moves the bridge 314 to the center of the tabletop 316. One tabletop 316*a* approximately 42 inches long or two tabletops 316*c*, having an overall length of approximately 51 inches, can then be mounted to the bridge 314. The bench-style seat 318*a* or the individual seats 318*b* can be used with either of the two tabletops 316*a*, 316*c*.

Figure 4:
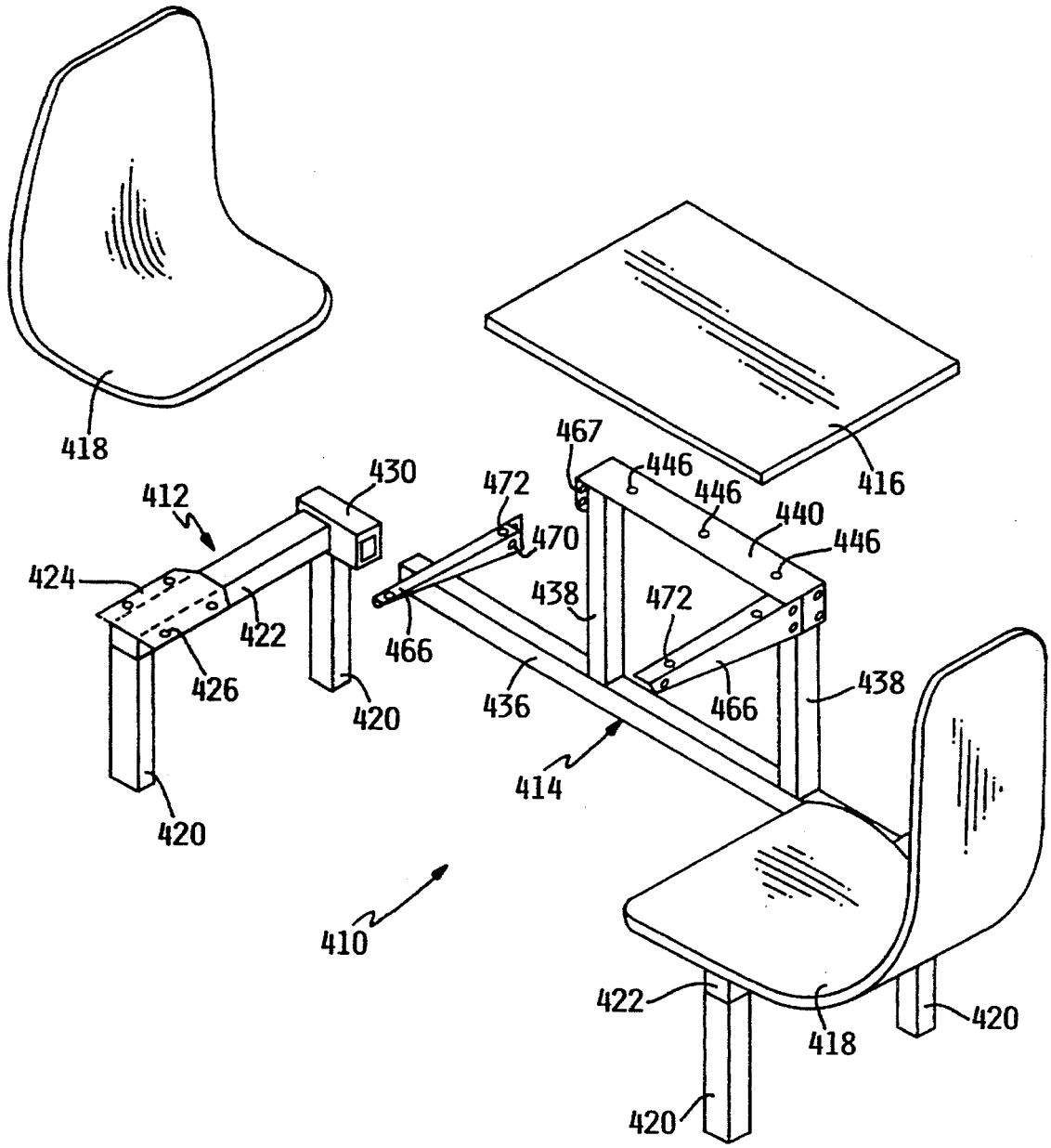
FIG. 4 is an exploded view showing the fourth embodiment.

FIG. 4 shows a fourth embodiment 410 of the present invention. The horses 412 of the fourth embodiment are approximately 19½ inches in length and have one or more seat-mounting plates 424. The horses 412 may support bench-style seats 418 approximately 24 inches in length or individual seats similar to seats 318*b* in FIG. 3. The tabletop 416 is approximately 24 inches in length.

Figure 5:
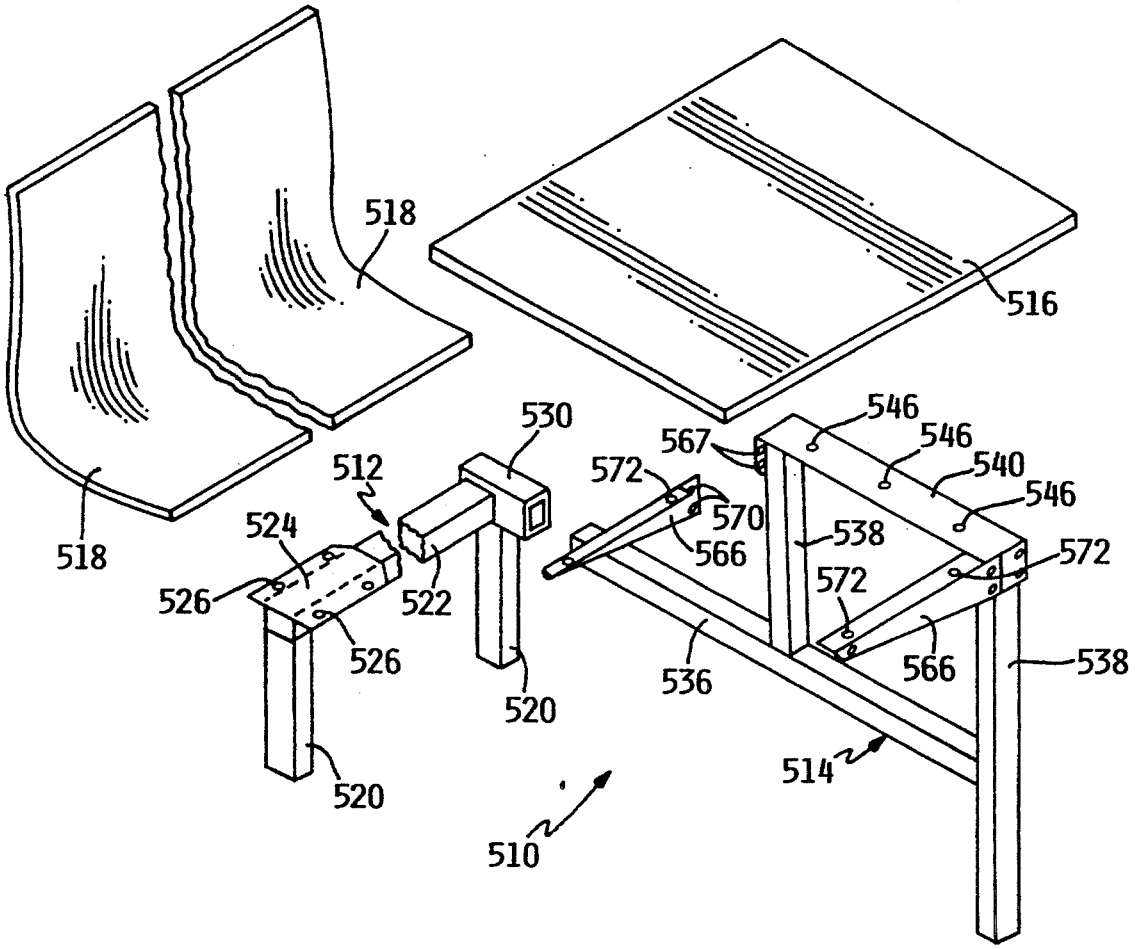
FIG. 5 is an exploded view showing the fifth embodiment.

FIG. 5 shows a fifth embodiment 510 of the present invention. The fifth embodiment is a wheelchair-accessible booth 510. The seat 518 may be between approximately 24 and 42 inches in length with a tabletop 516 length between approximately 30 and 48 inches. The tabletop 518 is elevated approximately 31¼ inches or higher to allow sufficient room for a wheelchair.

The bridge 514 may be similar to the bridges 314, 414 of the third or fourth embodiments with one modification. One side of the booth 510 does not have a horse 512. The bridge bar 536 ends at the vertical table support 538. The vertical support 538 extends past the horizontal bridge bar 536 to rest on the floor.

Figure 6:
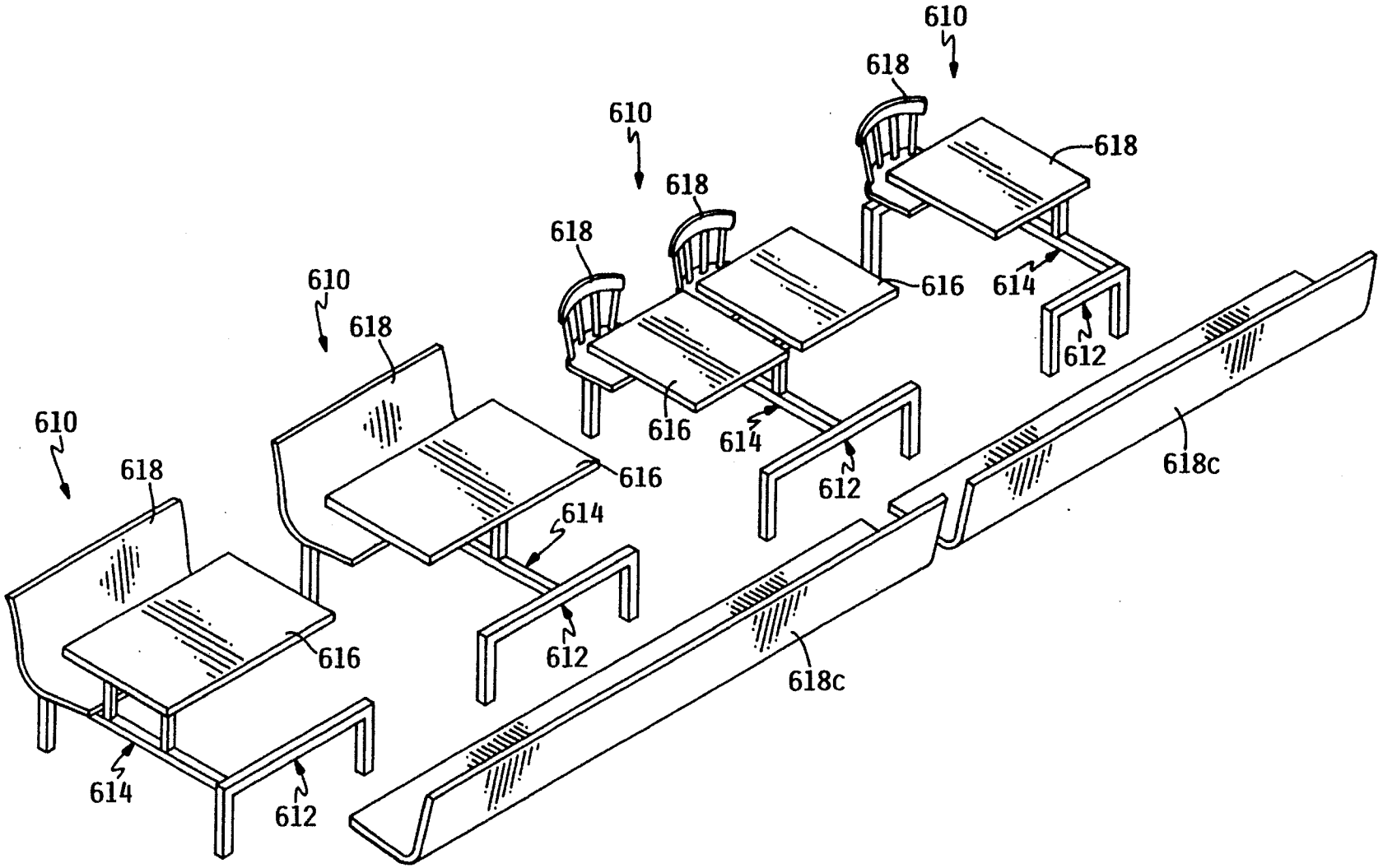
FIG. 6 is an exploded view showing the sixth embodiment.

FIG. 6 shows a sixth embodiment 610 of the present invention. The individual booths 610 may be similar to any one or more of the aforementioned embodiments. The booths 610 are placed in a string which can be connected with long bench-style seats 618*c*. The benches 618 attach to the horses 612 in a manner similar to that described above except that one bench 618*c* attaches to a plurality of horses 612. The benches 618*c* may be 71 to 143 inches in length. It is contemplated that the benches 618*c* will abut each other when installed.

In all of the embodiments shown in the figures, the use of the tubular sleeve mounted in the various positions shown permits considerable flexibility in both the construction of the component parts of the invention, and in the installation of one or more booth assemblies in a typical restaurant setting. By symmetrically mounting the tubular sleeve along an axis which is normal to the plane of the horse, the horse may be constructed as a single component part and utilized in a number of different mounting configurations. The elongate length of the tubular sleeve permits the horizontal bridge bar to be slidably accepted and locked within the tubular sleeve at a range of positions, thereby permitting a wide range of adjustment to the width of the booth configuration. Although typical, and sometimes preferred, dimensions for the respective component parts of the various booth configurations are shown herein, it is apparent that other and different dimensions might be utilized in particular applications. For example, the length of the tubular sleeve might be extended considerably to allow for a wider range of adjustment between the respective seating members; in certain configurations it might be advisable to insert two bridge bars of adjoining booths into a single tubular sleeve, to permit a single tubular sleeve to form a constructional part of two adjoining booth assemblies.

The present invention has been described with references to preferred embodiments such as specific dimensions. Workers skilled in the art will recognize that changes may be made in the form of detail without departing from the spirit and scope of the invention.

What is claimed:

1. A booth assembly comprising:

a first horse and a second horse, each of said horses having vertical support members joined to a horizontal member in a common plane;

a pair of tubular sleeves, each sleeve having a central opening aligned along an axis, each sleeve being affixed to a horse wherein said axis is normal to said common plane;

at least one seat disposed on and attached to said first horse and at least one seat disposed on and attached to said second horse, and each of said seats being sized to support at least one person;

a bridge, said bridge comprising a horizontal bridge bar joined to a plurality of vertical bridge bars, a tabletop attachment plate secured to said vertical bridge bars, and means for attaching a tabletop to said tabletop attachment plate, said horizontal bridge bar having a first end sized to be slidably received within a sleeve of said first horse, said horizontal bridge bar having a second end sized to be slidably received within a sleeve of said second horse, the relative positions of said first horse and said second horse being selectively adjustable along a length of said horizontal bridge bar; and a tabletop attached to said bridge via said tabletop attachment plate and said attaching means.

2. A booth assembly comprising:

at least one horse, each of said at least one horse having at least one vertical support member and a horizontal member aligned in a common plane;

a tubular sleeve member affixed to each of said at least one horse, said sleeve having an axis aligned normal to said common plane;

at least one seat disposed on said at least one horse, said seat being sized to support at least one person, and said seat being attached to the horizontal member of said horse;

a bridge, said bridge comprising a horizontal bridge bar and means for attaching a tabletop to said bridge bar, said bridge bar being slidably received within said sleeve of said at least one horse;

means for selectively affixing said horizontal bridge bar to said sleeve, for selectively adjusting the length of said horizontal bridge bar which extends from said sleeve; and a tabletop attached to said horizontal bridge bar via said attaching means.

3. The booth assembly of claim 2, wherein said means for attaching further comprises:

at least one vertical bridge member extending upwardly from said horizontal bridge member; and a table attachment plate joined to said vertical bridge member and to said tabletop.

4. The booth assembly of claim 3, wherein said means for attaching includes two vertical bridge members and said table attachment plate extends therebetween.

5. The booth assembly of claim 3, wherein said means for attaching further comprises:

at least one table arm attached to each vertical bridge member, said table arm providing support to said tabletop.

6. The booth assembly of claim 5, wherein said means for attaching further comprises two table arms attached to each vertical bridge member.

7. The booth assembly of claim 3, wherein said means for attaching further comprises:

a table brace, said table brace extending diagonally from said horizontal bridge bar to said tabletop, said table brace providing support to said tabletop.

8. The booth assembly of claim 2, wherein said sleeve is positioned directly above one of said at least one vertical members of said at least one horse.

9. The booth assembly of claim 2, wherein said sleeve is positioned adjacent an end of said horizontal member of said at least one horse.

10. The booth assembly of claim 2, wherein said sleeve is positioned equidistant from the ends of said horizontal member of said at least one horse.

11. The booth assembly of claim 2, further comprising:

at least one seat-mounting plate attached to each horse, said seat-mounting plate providing a means for attachment of said horse to said seat.

12. The booth assembly of claim 11, wherein two seat-mounting plates are attached to each horse.

13. The booth assembly of claim 2, further comprising:

a vertical leg, said vertical leg having a first end secured to said tabletop and a second end touching a floor.

14. The booth assembly of claim 2, wherein one seat is attached to each horse.

15. A booth assembly comprising:

two horses, each having vertical legs affixed to a horizontal member to form a common plane;

a tubular member, formed along a tubular axis, affixed to each of said horses with said tubular axis aligned normal to said common plane;

a bridge having a horizontal bridge bar slidably fittable into said tubular member;

means for affixing said horizontal bridge bar to said tubular member;

at least one seat disposed on each horse, said at least one seat being sized to support at least one person, and said at least one seat being attached to said horse;

means for attaching a table top to said horizontal bridge bar; and a table top attached to said horizontal bridge bar via said attaching means.

* * * * *